US009427959B2

(12) United States Patent
Zhang

(10) Patent No.: US 9,427,959 B2
(45) Date of Patent: Aug. 30, 2016

(54) LIQUID DISCHARGE APPARATUS, CONTROL METHOD OF LIQUID DISCHARGE APPARATUS, AND DEVICE DRIVER, AND PRINTING SYSTEM

(71) Applicant: SEIKO EPSON CORPORATION, Tokyo (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 14/849,872

(22) Filed: Sep. 10, 2015

(65) Prior Publication Data

US 2016/0067959 A1 Mar. 10, 2016

(30) Foreign Application Priority Data

Sep. 10, 2014 (JP) ..... 2014-183967

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/04541; B41J 2/04586; B41J 2/04535; B41J 2/0456; B41J 2/04571; B41J 2/04593; B41J 2/04595; B41J 2002/16529
See application file for complete search history.

(56) References Cited

U.S. PATENT DOCUMENTS 8,506,031 B2 * 8/2013 Abergel ..... B41J 2/04571 347/10

FOREIGN PATENT DOCUMENTS

| | | | |
|---|---|---|---|
| JP | 2004306416 A | * | 11/2004 |
| JP | 2006103209 A | * | 4/2006 |
| JP | 2013-107207 A | | 6/2013 |
| JP | 2013-121691 A | | 6/2013 |

* cited by examiner

*Primary Examiner* — Julian Huffman
*Assistant Examiner* — Michael Konczal
(74) *Attorney, Agent, or Firm* — Workman Nydegger

(57) ABSTRACT

The degree of thickening of ink for each of nozzles based on dot pattern data is calculated based on a thickening value $Z(n+1)=Z(n)\times a\times bs^{s}\times bm^{m}\times bl^{l}$, and information the dot pattern data corresponding to the nozzle, which indicates that small dots are formed in when the thickening value is equal to or greater than a threshold is replaced with information indicating that middle dots which are larger than the small dots are formed.

5 Claims, 6 Drawing Sheets

LIQUID DISCHARGE APPARATUS, CONTROL METHOD OF LIQUID DISCHARGE APPARATUS, AND DEVICE DRIVER, AND PRINTING SYSTEM

CROSS-REFERENCE TO RELATED APPLICATIONS

The present application claims priority to Japanese Patent Application No. 2014-183967 filed on Sep. 10, 2014, which is hereby incorporated by reference in its entirety.

BACKGROUND

1. Technical Field

The present invention relates to a liquid discharge apparatus, a control method of the liquid discharge apparatus, a device driver for the liquid discharge apparatus, and a printing system.

2. Related Art

Examples of an ink jet type recording apparatus (a printer) which is a type of a liquid discharge apparatus include a so-called serial type printer which feeds out the recording medium (an impacted object) such as recording paper in the direction orthogonal to a main scanning direction so as to sequentially execute sub scanning on the recording medium while reciprocating an ink jet type recording head which has a shorter width than that of the recording medium in the main scanning direction, and discharges ink from a nozzle of a recording head to record an image or the like on the recording medium. In the printer with such a configuration, when a solvent component of the ink from the nozzle is evaporated and thus the ink is thickened during a recording process (or referred to as a printing process), a flushing operation for discharging the thickened ink from the nozzle is executed (refer to JP-A-2013-121691). Since the flushing operation is a well-known art, the detailed description will be omitted, but in short, the recording process is stopped due to some reasons that a predetermined time has elapsed during the recording process, or a certain condition is established by monitoring a thickened state in the nozzle, and then ink from the nozzle is discharged in an area (a flushing point) in which the flushing is executed, that is, clearly flushed.

In addition, as a printer, a so-called line type printer which is provided with a recording head (a line type liquid discharge head) which includes a plurality of head unit groups, and in which the entire length of a nozzle group which is formed of the plurality of head unit groups in the width direction of the recording medium corresponds to the maximum recording width of the recording medium which is available in the printer, and executes recording with respect to the recording medium only by transporting the recording medium without scanning the recording head in the width direction of the recording medium, has been also proposed (refer to JP-A-2013-107207). In the above-described line type printer, since it is difficult to execute the flushing operation by moving the recording head to the flushing point in the middle of the recording process unlike the serial type printer, an area for flushing which is set in an outer margin portion of the area for recording an image or the like on the recording medium is flushed or the area for printing the image or the like on the recording medium is flushed so as not to be noticeable.

However, in the serial printer, since the flushing operation is executed during the recording process, there is a problem in that the image quality of a recorded image is degraded.

SUMMARY

An advantage of some aspects of the invention is to provide a liquid discharge apparatus which is capable of reducing defects due to thickening of the liquid even in a case where a flushing operation is not easily executed, a control method of the liquid discharge apparatus, a device driver, and a printing system.

According to an aspect of the invention, there is a provided a liquid discharge apparatus including: a liquid discharge head that includes a plurality of nozzles, discharges a liquid from the nozzles by driving of an actuator, and then forms dots with impacted liquids on an impacted object; a driving waveform generation circuit that generates a driving waveform for driving the actuator; and a control circuit that controls discharging of the liquid by the liquid discharge head based on discharge data including information indicating a size of a dot formed on the impacted object, in which the control circuit calculates a degree of thickening of the liquid for each of the nozzles, and discharges relatively large dots compared to small dots to an area on which relatively the smallest dots are supposed to be formed from the nozzles based on the discharge data when the degree of thickening of the liquid in the nozzle becomes a predetermined state which is determined in advance.

According to the invention, by discharging relatively large dots compared to small dots to an area on which relatively the smallest dots are supposed to be formed based on discharge data from the nozzles when the degree of thickening of the liquid in the nozzle becomes a predetermined state which is determined in advance, it is possible to maintain the amount of liquid droplets or the flying speed thereof when forming the small dots which are particularly likely to be affected by the thickening and thus the impact position deviation is likely to occur so as to close to the target value regardless of the thickening of liquid in the nozzle. In this way, it is possible to efficiently suppress, for example, degradation of the image quality (deviation from the image quality of the target) of an image recorded by the arrangement of dots by replacing the small dots with the large dots. In addition, in a so-called serial printer which is a type of the liquid discharge apparatus, since it is not necessary to frequently execute the flushing operation, it is possible to improve the processing speed. Further, in a so-called line type printer which is a type of the liquid discharge apparatus, since it is not necessary to execute the flushing operation with respect to the recording medium, it is possible to prevent defects such as degradation of the image quality of a recorded image.

It is preferable that when n is set to a natural number including 0, Z (0) is set to a constant indicating an initial value of the degree of thickening, a is set to a constant which is determined based on liquid characteristics, bs, bm, and bl are set to constants respectively relating to the small dot, a middle dot which is larger than the small dot, and a large dot which is larger than the middle dot, and s, m, and l are set to numbers of discharged ink droplets of each of the small dot, the middle dot, and the large dot during an n-th discharge period, the degree of thickening in a predetermined discharge period is represented by the following Expression.

$$Z(n+1)=Z(n)\times a\times bs^{s}\times bm^{m}\times bl^{l}$$

According to the above configuration, it is possible to recognize the degree of the thickening of liquid for each of the nozzles in advance based on the above Expression and the discharge data. Therefore, it is possible to prevent the processing speed of the discharging operation from being reduced in the liquid discharge apparatus.

According to another aspect of the invention, there is a provided a control method of a liquid discharge apparatus which includes a liquid discharge head that includes a plurality of nozzles, discharges a liquid from the nozzles by driving of an actuator, and then forms dots with impacted liquids on an impacted object; a driving waveform generation circuit that generates a driving waveform for driving the actuator; and a control circuit that controls discharging of the liquid by the liquid discharge head based on discharge data including information indicating a size of a dot formed on the impacted object, the method including: calculating degree of thickening of a liquid for each of the nozzles; and discharging relatively large dots compared to small dots to an area on which relatively the smallest dots are supposed to be formed based on the discharge data from the nozzles when the degree of thickening of the liquid in the nozzle becomes a predetermined state which is determined in advance.

According to a further aspect of the invention, there is a provided a device driver that is executable in a host apparatus which is communicably connected to a liquid discharge apparatus that includes a plurality of nozzles, discharges a liquid from the nozzles by driving of an actuator, and then forms dots with impacted liquids on an impacted object, the device driver causing the host apparatus to execute: generating discharge data which includes information indicating a size of dots formed on an impacted object from job data for causing the liquid discharge apparatus to execute a liquid discharge operation; calculating degree of thickening of a liquid based on the discharge data for each of the nozzles; and replacing information of the discharge data corresponding to the nozzles, which indicates that relatively smallest dots are formed with information indicating that dots which are larger than small dots are formed when the degree of thickening of the liquid in the nozzle becomes a predetermined state which is determined in advance.

According to the invention, by replacing information indicating that relatively smallest dots are formed in the discharge data corresponding to nozzles with information indicating that dots which are larger than small dots are formed when the degree of thickening of the liquid in the nozzle becomes a predetermined state which is determined in advance, it is possible to maintain the amount of liquid droplets or the flying speed thereof when forming the small dots which are particularly likely to be affected by the thickening and thus the impact position deviation is likely to occur so as to close to the target value regardless of the thickening of liquid in the nozzle. In this way, it is possible to efficiently suppress, for example, degradation of the image quality (deviation from the image quality of the target) of an image recorded by the arrangement of dots by replacing the small dots by the large dots.

In addition, in consideration that it is necessary to execute a replacing process (a correcting process) of dots in the discharge data by recognizing the degree of thickening corresponding to all the nozzles in the line type liquid discharge head, the recognition of the degree of thickening (prediction) and the correcting process of the discharge data are executed by the device driver of the host apparatus which has a high-performance computing capability compared with that of the typical liquid discharge apparatus, and then the discharge data is corrected when the degree of thickening becomes a predetermined state, and therefore, since there is no additional process for the liquid discharge apparatus, there is no concern in that the liquid discharging operation is deteriorated.

According to a further aspect of the invention, there is a provided a device driver that is executable in a host apparatus which is communicably connected to a liquid discharge apparatus that includes a plurality of nozzles, discharges a liquid from the nozzles by driving of an actuator, and then forms dots with impacted liquids on an impacted object, the device driver causing the host apparatus to execute: generating discharge data which includes information indicating a size of dots formed on an impacted object from job data for causing the liquid discharge apparatus to execute a liquid discharge operation; calculating degree of thickening of a liquid based on the discharge data for each of the nozzles; and replacing information of the discharge data corresponding to the nozzles, which indicates that relatively smallest dots are formed with information indicating that dots which are larger than small dots are formed when the degree of thickening of the liquid in the nozzle becomes a predetermined state which is determined in advance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described with reference to the accompanying drawings. Incidentally, in the embodiments described below, there are various limitations as preferred specific examples of the invention, but the scope of the present invention is not limited to these embodiments unless there is a particular description to limit the invention in the following description.

Figure 1:
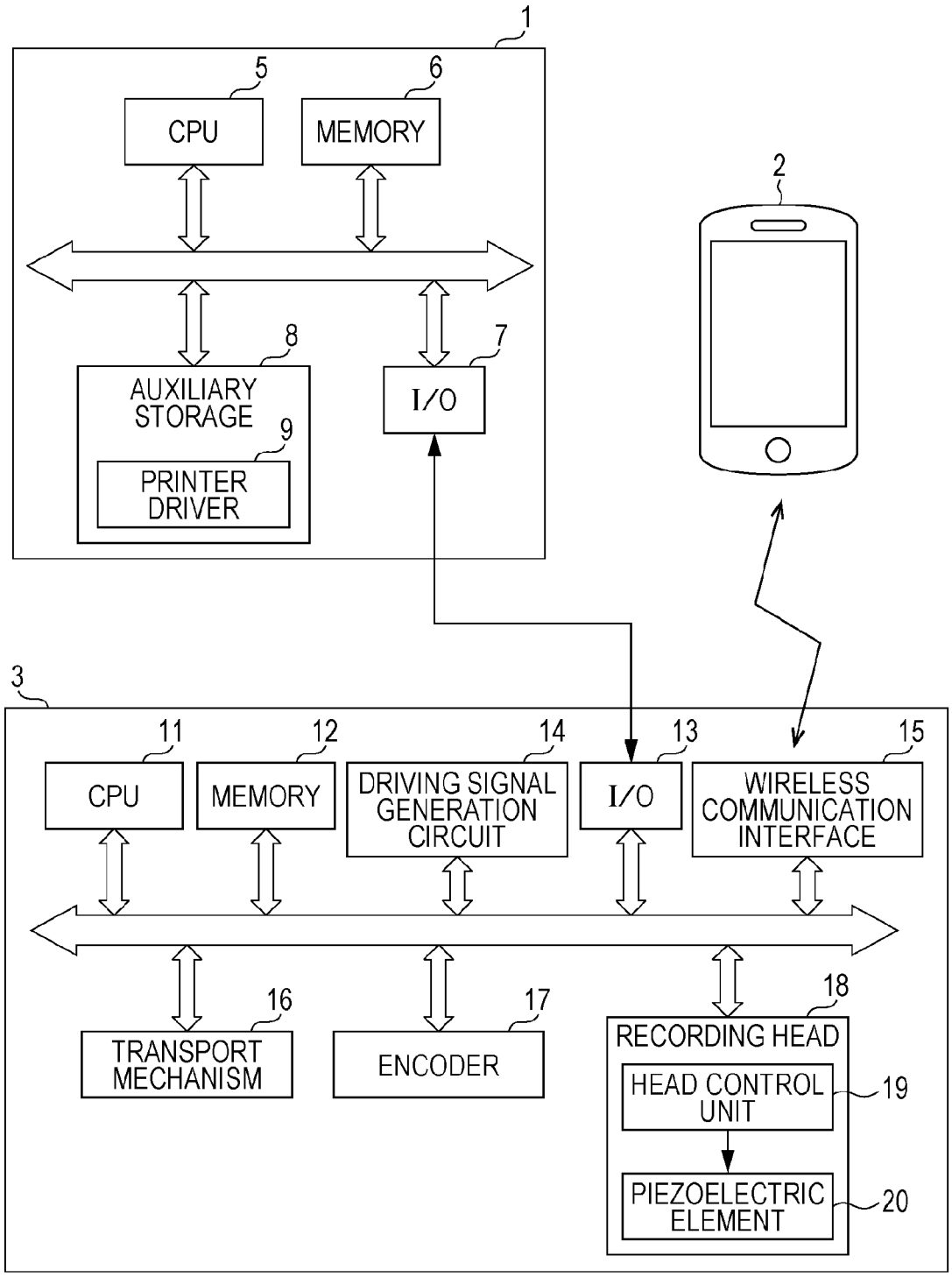
FIG. 1 is a block view illustrating a configuration of a printing system.

FIG. 1 is a block view illustrating a printing system according to the invention.

The printing system is configured that a host apparatus such as a host computer 1 or a mobile phone (a smart phone) 2, an ink jet printer (hereinafter, simply referred to as a printer) 3, and the like are communicably connected to each other by wire system or radio system. Note that, as the host apparatus in the following description, mainly the host computer 1 will be described as a representative example.

The host computer 1 is provided with a CPU 5, a memory 6, an input and output interface (I/O) 7, an auxiliary storage 8, and the like, and these are connected to each other via an internal bus. The auxiliary storage 8 is formed of, for example, a hard disk drive, and stores an operation program, a variety of application programs, and a device driver such as a printer driver 9. In addition, the CPU 5 executes a variety of processes such as the application program or the printer driver 9 in accordance with an operation system stored in the auxiliary storage 8. The input and output interface 7 is formed of, for example, an interface such as a USB or an IEEE 1394, and is connected to an input and output interface 13 in the printer 3 in such a manner that requirements of a recording process or the like which is created by the printer driver 9 or data relating to the printing to the printer 3. The printer driver 9 is a program for executing a process of converting image data (image data, text data, or the like) made by the application program into dot pattern data (corresponding to the discharge data in the invention, also referred to as raster data) which is used in the printer 3 or executing a variety of print setting. Meanwhile, a process of the printer driver 9 will be described later.

The printer 3 in the embodiment is provided with, for example, a CPU 11, a memory 12, the input and output interface 13, a driving signal generation circuit 14, a wireless communication interface 15, a transport mechanism 16, an encoder 17, and a recording head 18.

Figure 4:
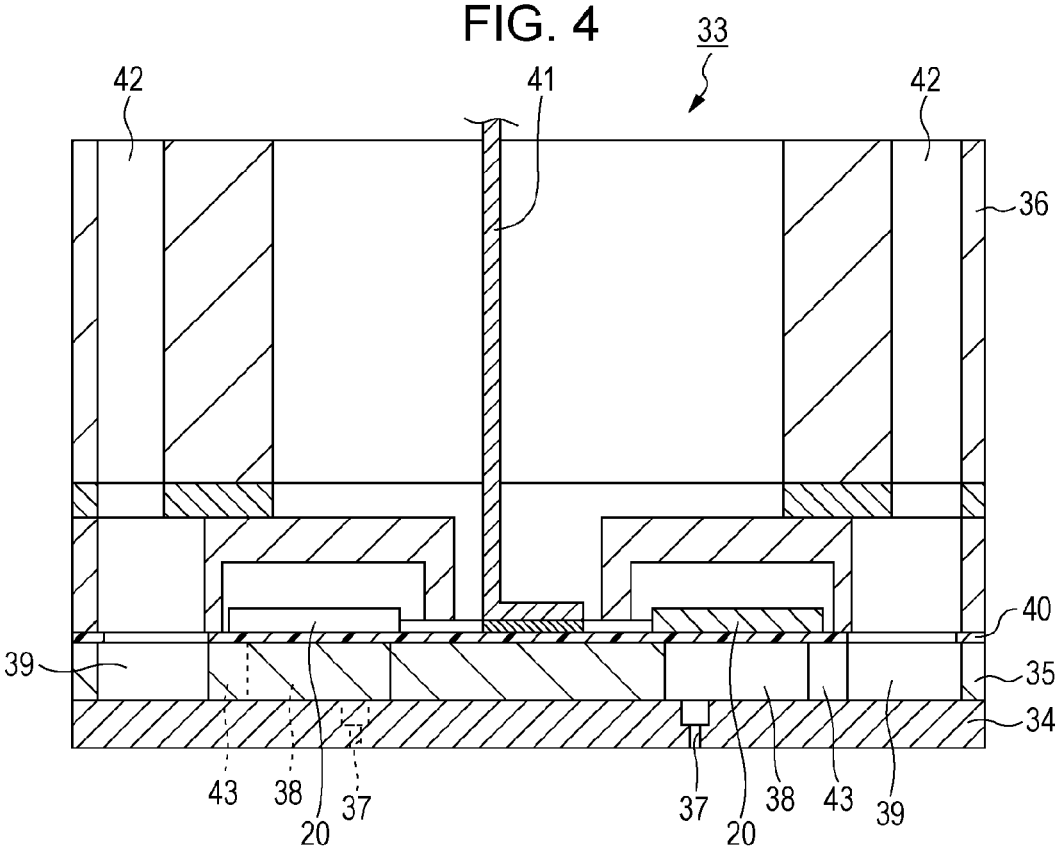
FIG. 4 is a sectional view illustrating a configuration of a head unit.

The input and output interface 13 executes transmission and reception of various items of data by receiving requirements of a recording process or the like or data relating to the printing from the host computer 1 which is a type of the host apparatus and outputting the state information of the printer 3 to the host computer 1. The CPU 11 is a processor controller for controlling the entire printer. The memory 12 is an element for storing data which is used to execute the program of the CPU 11 or a variety of controls, a ROM, a RAM, and an NVRAM (a nonvolatile storage element). The CPU 11 controls each unit in accordance with the program which is stored in the memory 12. In addition, the CPU 11 of the embodiment transmits the dot pattern data to a head control unit 19 of the recording head 18 from the host apparatus. The driving signal generation circuit 14 (corresponding to a driving waveform generation circuit in the invention), based on waveform data relating to the waveform of a driving signal, generates an analog signal and then amplifying the signal so as to generate a driving signal COM (described later) as illustrated in FIG. 4. The wireless communication interface 15 is, for example, an interface for wireless communication based on a specification of communication such as Bluetooth (a trade mark) or Wi-Fi (the trade mark), and performs the transmission and reception of data by wirelessly connecting the printer 3 and the host apparatus such as the mobile phone 2. Meanwhile, as a method of connecting the printer 3 and the host apparatus, various methods can be adopted without being limited to the above description. In addition, the same printer driver as the printer driver 9 described above can be executed in the mobile phone 2 as well.

Figure 2:
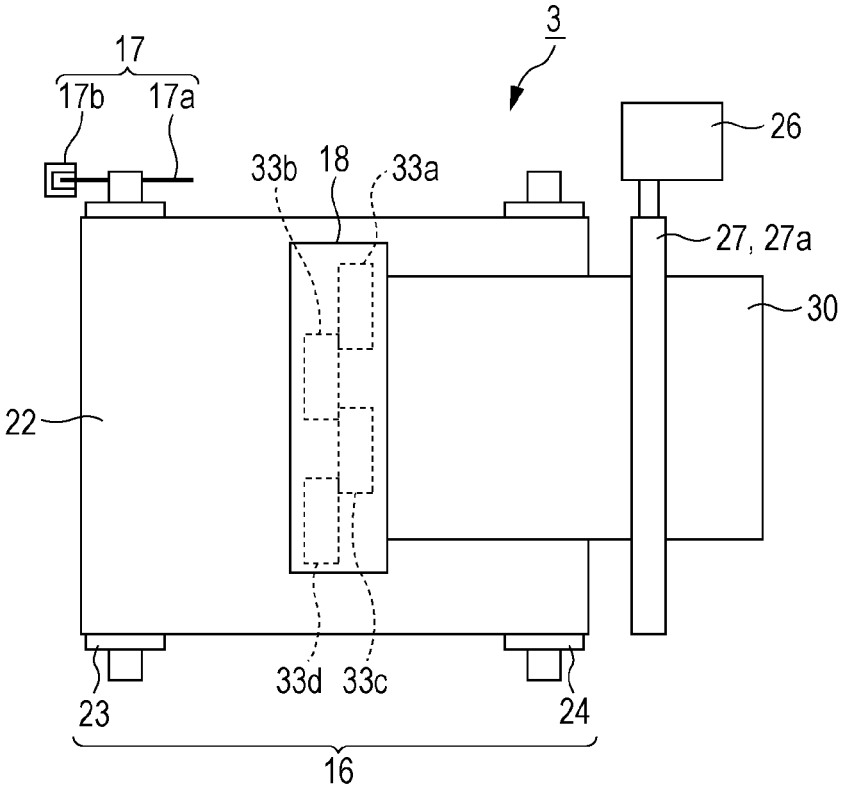
FIG. 2 is a plan view illustrating an internal configuration of a printer.
Figure 3:
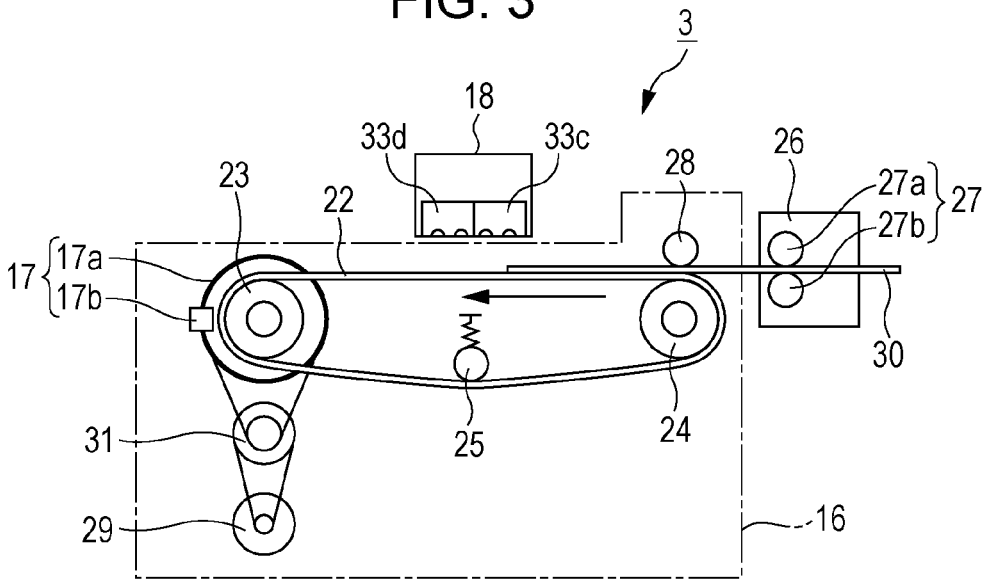
FIG. 3 is a perspective view illustrating the internal configuration of the printer.

FIG. 2 is a plan view illustrating an internal configuration of the printer 3 and FIG. 3 is a perspective view illustrating the internal configuration of the printer 3. The printer 3 in the embodiment is a type of the liquid discharge apparatus which sequentially transports a recording paper 30 (the recording medium or a type of the impacted object) such as roll paper, and at the same time, forms dots by discharging ink which is a type of a liquid form the recording head 18 to the recording paper 30 so as to impact the ink on the recording paper 30, and thus forms an impact pattern such as an image or text by the arrangement of dots. The printer 3 in the embodiment is schematically formed of a recording head 18 (a type of the liquid discharge head) which includes a plurality of head units 33*a* to 33*d*, a paper feeding roller 27 which supplies the recording paper 30 to the transporting belt 22, a paper feeding motor 26 with drives the paper feeding roller 27, a transport mechanism 16 which transports the recording paper 30 by the transporting belt 22, and an encoder 17 which detects an amount of transportation of the recording paper 30 by the transport mechanism 16 (for example, a rotary encoder).

The paper feeding roller 27 is formed of a pair of up and down rollers 27*a* and 27*b* which are synchronously rotatable in the direction opposite to each other in a state of being disposed on the upper stream of the transport mechanism 16, and interposing the recording paper 30 fed from a paper feeding unit (not shown) therebetween. The paper feeding roller 27 is driven by a driving force generated from the paper feeding motor 26, and supplies the recording paper 30 to the transport mechanism 16. The transport mechanism 16 is formed of a transport motor 29 which is a driving source of the transporting belt 22, a driving roller 23, a speed reducing mechanism 31 which transfers the driving force of the motor 12 to the driving roller 23 by reducing the rotation speed of the transport motor 29, a driven roller 24 which is disposed on the upper stream of the driving roller 23, the endless transporting belt 22 which stretches between the driving roller 23 and the driven roller 24 in a tense state, a tension roller 25 which imparts tension to the transporting belt 22, and a pressure roller 28 which presses the recording paper 30 onto the transporting belt 22. The tension roller 25 is disposed between the driving roller 23 and the driven roller 24, and makes internally contact with the transporting belt 22 so as to impart the tension to the transporting belt 22 by a biasing force of a biasing member such as a spring. In addition, the pressure roller 28 is disposed right above the driven roller 24 by interposing the transporting belt 22 therebetween, and abuts on the transporting belt 22.

The encoder 17 which is formed of an encoder scale 17*a* and a detecting head 17*b* are provided on a rotation shaft of the driving roller 23. The encoder scale 17*a* is formed of a plurality of slits (stripe) which are the one formed on the entire periphery disk at equal angular intervals along an outer periphery of a disk-shaped plate. The encoder scale 17*a* may be formed by forming the slits to which the light is transmitted on a disk-like plate to which light is not transmitted, or the slits to which the light is not transmitted on the disk-like plate to which light is transmitted. In addition, the detecting head 17*b* optically detects the slits which are moved with the rotation of the driving roller 23. The detecting head 17*b* is formed of a pair of a light-emitting element and a light-receiving element (which are not shown) which are disposed so as to face each other, and outputs an encoder pulse EP in accordance with a difference between a light-receiving state in a slit part of the encoder scale 17*a* passing between the light-emitting element and the light-receiving element and a light-receiving state in other parts except for the slit part. The encoder pulse EP is output to the CPU 11 of the printer 3 (refer to FIG. 1). Accordingly, based on the encoder pulse EP, the CPU 11 can recognize an amount of transportation and transport speed of the recording paper 30 by the transport mechanism 16. In addition, the encoder pulse EP defines the generation timing of the driving signal (a drive waveform) for driving a piezoelectric element 20 which is the actuator of the recording head 18. Note that, an example of the encoder 17 is not limited to the above description, and can be any one as long as it is possible to detect the amount of transportation (the transport speed) of the recording paper 30.

FIG. 4 is a sectional view of a main part illustrating an internal configuration of the head unit 33 which forms the recording head 18. FIG. 4 illustrates a configuration of a part of the head unit. The recording head 18 in the embodiment is provided with the plurality of head units 33 which are illustrated in FIG. 4. In addition, the nozzle rows having these head units 33 are arranged in the width direction of the recording paper 30 (in other words, the direction orthogonal to the transport direction of the recording paper 30), and the entire length of the nozzle rows can correspond to the maximum width of the recording paper 30 which is printable in the printer 3. Meanwhile, the adjacent nozzle rows of the head unit 33 are disposed so as to be deviated from each other in the transport direction of the recording paper 30.

The head unit 33 in the embodiment is schematically formed of, for example, a nozzle plate 34, a channel substrate 35, and a piezoelectric element 20, and is attached to a case 36 in a state where the above members are stacked to each other. The nozzle plate 34 is a member formed of a silicon single crystal substrate in which a plurality of nozzles 37 are arranged in a row at a pitch corresponding to the formation density of dots along the direction orthogonal to the sub scanning direction. The nozzle 37 is formed into an annular shape through the dry etching. In the embodiment, two nozzle rows (a type of the nozzle group) which is formed of a plurality of nozzles 37 which are arranged in parallel are arranged in parallel on the nozzle plate 34. In addition, a surface onto which the ink of the nozzle plate 34 is discharged corresponds to a nozzle surface. Meanwhile, the nozzle plate 34 is not limited to the silicon single crystal substrate, for example, can be formed of a metallic plate such as a stainless steel.

On the channel substrate 35, a pressure chamber 38 is partitioned into plural parts by using a plurality of partition walls so as to correspond to each nozzle 37. A common pressure chamber 39 which partitions the pressure chamber 38 is formed on the outer side of the pressure chamber 38 on the channel substrate 35. The common pressure chamber 39 communicates each pressure chamber 38 via an ink supply port 43. In addition, the ink is introduced to the common pressure chamber 39 from an ink storing member (not shown) via an ink introduction path 42 of the case 36. The piezoelectric element 20 is formed on the upper surface opposite to the nozzle plate 34 of the channel substrate 35 via an elastic membrane 40. The piezoelectric element 20 is formed by sequentially stacking a lower electrode film which is made of metal, a piezoelectric layer which is made of lead zirconate titanate or the like, and an upper electrode film which is made of metal (which are not shown). The piezoelectric element 20 is a so-called flexure mode piezoelectric element, and is formed so as to cover the upper portion of the pressure chamber 38. Each of the piezoelectric elements 20 is deformed by applying the driving signal through a wiring member 41. With this, pressure fluctuation occurs in the ink in the pressure chamber 38 corresponding to the piezoelectric element 20, and the ink is discharged from the nozzle 37 by controlling the aforementioned pressure fluctuation in the ink.

Figure 5:
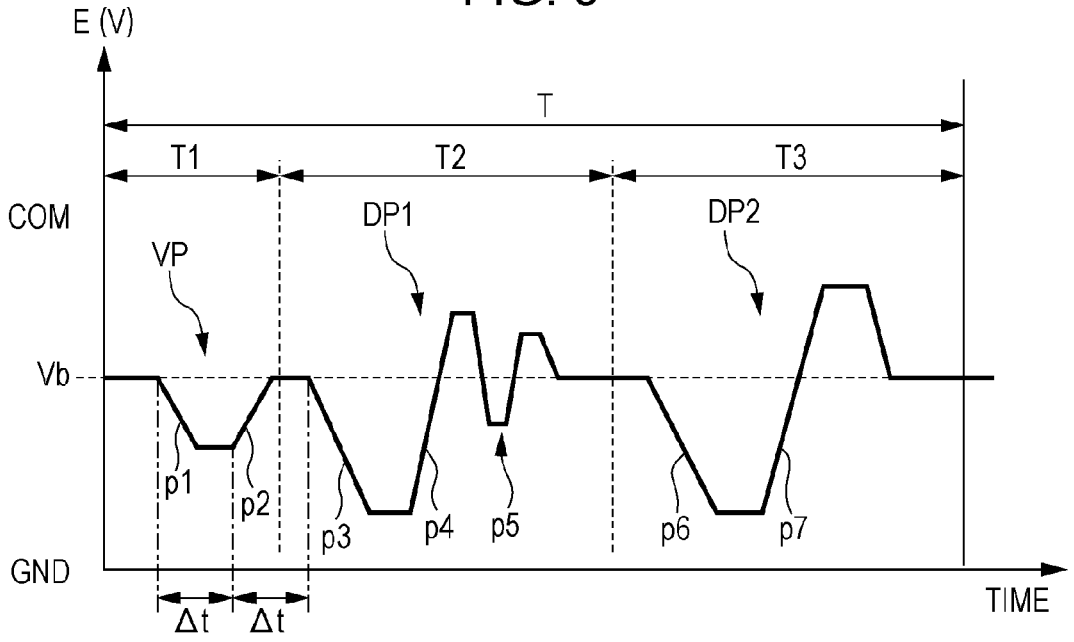
FIG. 5 is a waveform chart illustrating a configuration of a driving signal.

FIG. 5 is a waveform chart illustrating a configuration of the driving signal COM which is generated by the driving signal generation circuit 14. The driving signal COM is repeatedly generated by the driving signal generation circuit 14 for each unit period T (corresponding to a discharge period in the invention) which is defined by a timing signal generated based on the above-described encoder pulse EP. The unit period T corresponds to 1 pixel such as an image printed on the recording paper 30. In the embodiment, the unit period T is divided into three periods of T1 to T3. Then, a micro vibration driving pulse VP is generated during a first period T1, a first discharge driving pulse DP1 is generated during a second period T2, and a second discharge driving pulse DP2 is generated during a third period T3. Then, during the recording process, when a line (one raster) for a dot pattern is formed on the recording paper 30 as a recording area, any one or more of the driving pulses VP, DP1, and DP2 are selectively applied to the piezoelectric element 20 which is provided in each pressure chamber 38.

The micro vibration driving pulse VP (corresponding to the vibration driving wave form in the invention) is a driving pulse for vibrating (that is, micro vibration) the ink in the pressure chamber 38 and the nozzle 37 to the extent that the ink is not discharged from the nozzle 37. Specifically, the micro vibration driving pulse VP includes a waveform element p1 in which a potential is changed at a relatively gentle gradient the potential from a reference potential Vb corresponding to a reference state (an initial state) of the displacement of the piezoelectric element 20 so as to expand the pressure chamber 38, and a waveform element p2 in which the potential is changed at a relatively gentle gradient from a terminal potential of the waveform element p1 to the reference potential Vb so as to expand the pressure chamber 38 to the reference state. Here, the pressure vibration which is changed during a natural period Tc called a Helmholtz period is generated in the ink in the pressure chamber 38. Then, the time Δt from a start end of the waveform element p1 to a start end of the waveform element p2 is set to a half of the period Tc of the pressure vibration which is generated in the ink in the pressure chamber 38. With this, it is possible to efficiently micro-vibrate the ink by resonating the pressure vibration which is generated by the waveform element p1 and the pressure vibration which is generated by the waveform element p2.

Note that, it is possible to generally indicate the Helmholtz period (a natural vibration period of ink) Tc with the following Expression (1).

$$Tc=2\pi\sqrt{\{(Mn+Ms)/(Mn\times Ms\times(Cc+Ci))\}} \quad (1)$$

In Expression (1), Mn represents inertance of the nozzle 37 (mass of ink per unit sectional area which is described below), Ms represents inertance of the ink supply port 43, Cc represents compliance of the pressure chamber 38 (volume change per unit pressure, or degree of softness), and Ci represents compliance of ink (Ci=Volume V/[density ρ×speed of sound $c^2$]).

The first discharge driving pulse DP1 is a driving pulse (corresponding to the small dot driving waveform in the invention) for discharging ink droplets which correspond to relatively the smallest dots (small dots) among dots which can be formed in the printer 3 from the nozzle 37, and is provided with a waveform element p3 in which a potential is changed at a relatively gentle gradient from the reference potential Vb to a negative electrode (grounding polarity) so as to expand the pressure chamber 38, and a waveform element p4 in which a potential is changed at a relatively steep gradient from a terminal potential of the waveform element p3 to a positive electrode by exceeding the reference potential Vb so as to abruptly contract the pressure chamber 38. In addition, the first discharge driving pulse DP1 is provided with a group of the waveform elements (a waveform portion) p5 for reducing the size of liquid droplets discharged from the nozzle 37. The waveform portion p5 has an action of pulling a rear end port of the ink droplets which are temporarily discharged from the nozzle 37 to the pressure chamber again, and thus it is possible to miniaturize the ink droplets discharged from the nozzle 37.

In contrast, the second discharge driving pulse DP2 is a driving pulse (corresponding to the dot driving waveform in the invention) for discharging the ink droplet corresponding to the middle dot which is larger than the small dot from the nozzle 37, and is provided with a waveform element p6 in which a potential is changed at a relatively gentle gradient from a reference potential Vb to a negative electrode so as to expand the pressure chamber 38, and a waveform element p7 in which a potential is changed at a relatively steep gradient from a terminal potential of the waveform element p6 to a positive electrode by exceeding the reference potential Vb so as to abruptly contract the pressure chamber 38. In relation to the second discharge driving pulse DP2, a waveform portion corresponding to the waveform portion p5 of the first discharge driving pulse DP1 is not provided, and a driving voltage (a potential difference between the lowest potential and the highest potential) is set to be higher than that of the first discharge driving pulse DP1. Therefore, the ink droplet discharged from the nozzle 37 becomes larger. Meanwhile, since the configuration of the driving pulse is known, the detailed description will be omitted.

Figure 6A:
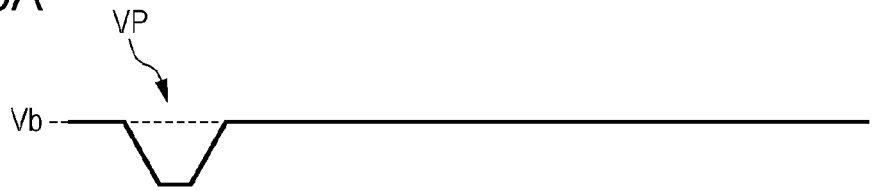
FIGS. 6A to 6D are waveform charts illustrating selection of a driving pulse.

FIGS. 6A to 6D are diagrams illustrating selection pattern of the driving pulse in the driving signal COM. In the printer 3 of the embodiment, it is possible to execute multi-tone recording that forms dots having different sizes on the recording paper 30, and the embodiment is configured so as to execute the recording process (the liquid discharging operation) with four gradations corresponding to a large dot, a middle dot, a small dot, and a non-recorded area (micro vibration). In the above-described configuration, in a case of the non-recorded area in which the ink is not discharged from a predetermined nozzle 37 during a predetermined unit period T, as illustrated in FIG. 6A, only the micro vibration driving pulse VP in the period T1 is selected and then applied to the piezoelectric element 20 so as to executed the micro vibration. With this, the ink in the nozzle 37 or the pressure chamber 38 is stirred, and thus the thickening of ink is reduced.

Figure 6B:
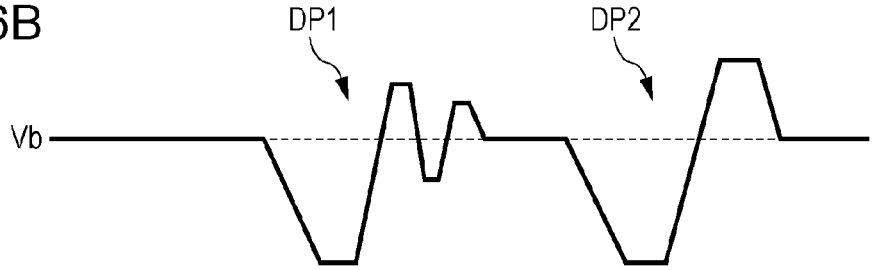
Figure 6C:
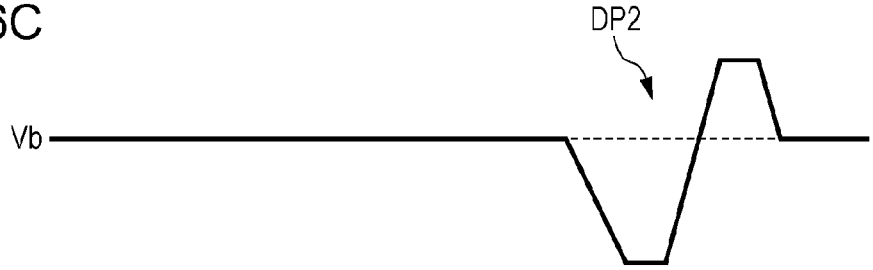

In a case where the large dot is formed during a predetermined period T, as illustrated in FIG. 6B in the embodiment, the first discharge driving pulse DP1 during the period T2 and the second discharge driving pulse DP2 during the period T3 are respectively selected and then sequentially applied to the piezoelectric element 20. With this, the ink droplets corresponding to the small dots are discharged from the nozzle 37, and then the ink droplets corresponding to the middle dots are discharged from the same nozzle 37. In addition, the large dots are formed by sequentially impacting these ink droplets with respect to the pixel area on the recording medium. In addition, the middle dots are formed during a predetermined unit period T, in the embodiment, as illustrated in FIG. 6C, only the second discharge driving pulse DP2 in the period T3 is selected so as to be applied to the piezoelectric element 20. With this, the ink droplets corresponding to the middle dots from the nozzle 37 are discharged once, and thus the middle dots are formed by impacting these ink droplets with respect to the pixel area on the recording medium.

Figure 6D:
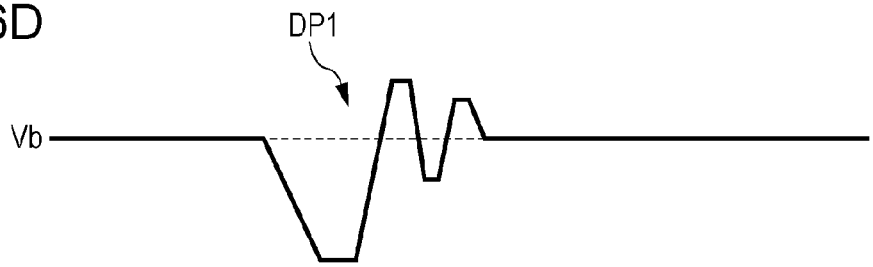

In addition, when the small dots are formed during a predetermined unit period T, generally, as illustrated in FIG. 6D in the embodiment, only the first discharge driving pulse DP1 during the period T2 is selected so as to be applied to the piezoelectric element 20. With this, the ink droplets corresponding to the small dots from the nozzle 37 are discharged once, and thus the small dots are formed by impacting these ink droplets with respect to the pixel area on the recording medium. Meanwhile, as described below, in a case where the degree of the thickening of ink in the nozzle 37 becomes a predetermined state, an alternative driving waveform is selected instead of the first discharge driving pulse DP1. In this regard, it will be described below.

In this way, regarding what size of dot is formed with respect to an area in which an image is to be formed on the recording paper 30, or whether or not dots are not formed, that is, which of the driving pulses in the driving signal COM is selected, the head control unit 19 executes based on dot pattern data (raster data). That is, the dot pattern data includes information regarding the discharge periods, the nozzles to discharge ink, and the sizes of dots which are required to form dots.

Meanwhile, during the recording process, since the nozzle 37 is exposed in the atmosphere, a solvent component in the ink in the nozzle 37 relatively having a few chances to discharge the ink is evaporated, and thereby the ink in the nozzle 37 is gradually thickened. When the ink is thickened, particularly, the small dots are formed by discharging the smaller ink droplets, there is a concern in that the amount of the ink droplets discharged from the nozzle 37 is reduced, or a flying direction of the ink droplets is deviated from the anticipated direction. In this case, the impact position of the ink droplets with respect to the printing paper 30 is deviated from an original target position, as a result, it is likely that image quality of an image or the like which is recorded on the printing paper 30 is deteriorated (deviation from the image of the original target). Meanwhile, in a so-called line type printer such as the printer 3 in the embodiment, a configuration is different from a configuration in that the recording process is executed while scanning the recording head in a so-called serial type of the printer, and it is difficult to execute the flushing operation of discharging the thickened ink during the recording process. That is, the flushing operation can be performed only at the time when the recording of at least one sheet of paper is completed in the recording process with respect to the sheet-like recording paper 30, or after a series of recording processes with respect to the roll recording paper is competed in the recording process with respect to the roll recording paper 30.

In this regard, in the printing system of the embodiment, based on the dot pattern data, the thickening of ink for each of the nozzles 37 is calculated (that is, estimated), and in a case where an estimated value of the degree of thickening is a predetermined value, when the small dots are formed during a predetermined period, the control is executed to select the alternative driving waveform having high discharge capability of the ink compared with a case where the first discharge driving pulse DP1 is selected. In the embodiment, the above-described main process is executed by the printer driver 9 which is executed in the host computer 1.

Figure 7:
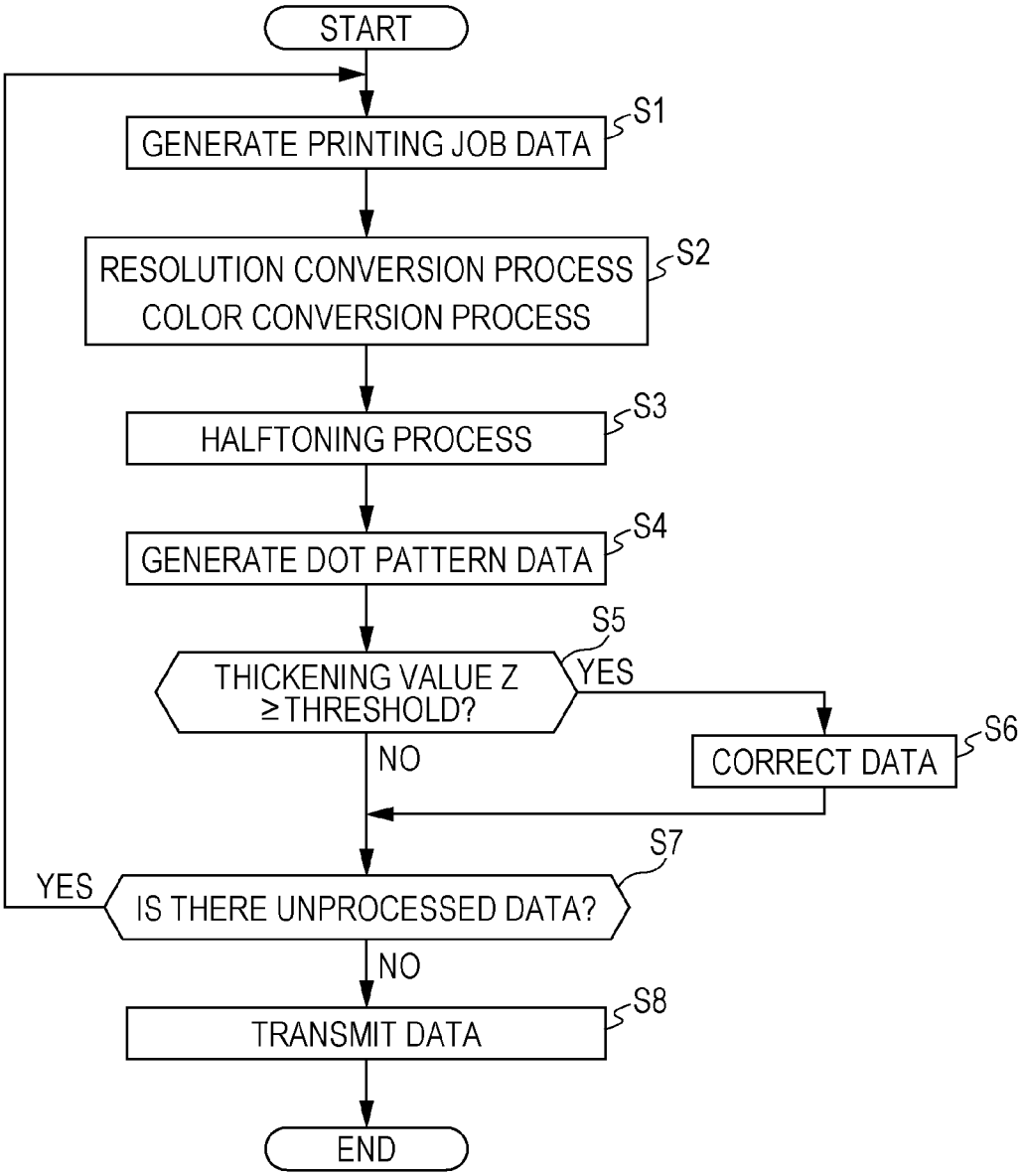
FIG. 7 is a flow chart illustrating a process of the printer driver.

FIG. 7 is a flow chart illustrating a process of the printer driver 9.

the printer driver 9, first, generates printing job data (corresponding to job data in the invention) for executing the recording process in the printer 3 based on the print setting or the like which is designated by a user through image data or text data, and a graphic user interface (GUI) which are created by using the application program or the like (step S1). Image data such as application is, for example, matrix data values of pixels (gradation values) which form an image are arranged in a matrix state and the respective value of pixels are indicated, for example, by data bits of 8 bits. That is, the gradation value of the respective pixels is indicated by two values corresponding to any value from a value 0 which indicates the darkest state to a value 255 which indicates the brightest state. Then, in a case of a color image, an item of image data is formed of the matrix data of red (R), green (G), and blue (B).

The printer driver 9 executes a resolution conversion process for matching resolution of the image data (an original image) resolution which can be printed in the printer 3, and then executes a color conversion process (step S2). For example, in a case of a color image, the image data is formed of the matrix data by three colors of red (R), green (G), and blue (B); however, the printer driver 9 converts the image data represented by color expression of R, G, and B into color expression by four colors of C (cyan), M (magenta), Y (yellow), and K (black) based on a table illustrating a correspondence relation between the respective colors R, G, and B, and ink colors used in the printer 3, that is, the respective colors of C, M, Y, and K.

The color-converted image data is formed of the matrix data of C, M, Y, and K on which the color conversion is executed, and as described above, each pixel obtains the value of 256 gradations. On the other hand, in the printer 3, as described above, the recording is executed with four gradations corresponding to the large dot, the middle dot, the small dot, and the non-recorded area. For this reason, the printer driver 9 converts the color-converted image data into data expressed with four gradations (step S3). Specifically, the color-converted image data is converted into data including information indicating the sizes of dots to be formed as a pixel, or the non-recorded area. Such a conversion process is also referred as a halftoning process.

In a case where the above-described halftoning process is executed, the printer driver 9 is assumed to be dot pattern data (corresponding to discharge data in the invention) by executing a process of rearranging pixels (step S4). The aforementioned process executes rearranging of the data converted into a mode indicating the existence of the dot formation through the halftoning process, in an order to be transferred to the printer 3. As above-described, the printer 3 executes the printing and recording of the image by discharging the ink droplets from the nozzle 37 of the recording head 18 so as to form dots on the recording paper 30. At this time, a first nozzle row is formed of the plurality of nozzles 37, and thus it is possible to form a dot line corresponding to the length of the nozzle row on the recording paper 30 at once. In addition, the nozzle rows of each of the head units 33 in the recording head 18 are differently arranged from each other in the transport direction, and thus in the recording process in the printer 3, in order to print one dot line (that is, one raster) with respect to the recording paper 30, the following control is executed; the recording paper 30 is transported by distance corresponding to the deviation between the nozzle rows after forming a first dot line, and then the dot line corresponding to one raster is recorded by forming a second dot line between the previously formed dot lines. In this way, the order of forming the raster on the recording paper 30 by the printer 3 is different from the order of image on the image data, and thus the printer driver 9 executes rearranging in the process of rearranging pixels.

The data has been subjected to the data conversion process is sequentially transmitted to the printer 3 as described below after being temporarily spooled by the memory 6 or the auxiliary storage 8 as the dot pattern data, and in the printer 3, the ink droplets are discharged with respect to the recording paper 30 based on the dot pattern data, that is, the recording process is executed. Here, the printer driver 9 calculates the degree of the thickening of ink for each nozzle of the recording head 18 during the recording process based on the dot pattern data. That is, the printer driver 9 estimates the degree of the thickening of ink (a thickened state) at the time of actually discharging the ink droplets from the nozzle 37. More specifically, the printer driver 9 estimates the degree of thickening of the ink discharged from each nozzle based on the following Expression representing a value indicating the degree of the thickening of ink (hereinafter, referred to as a thickening value) during the recording process. That is, a thickening value Z (n+1) is set for each nozzle 37 in the recording head 18, and managed by the memory 6 or the like in the host computer 1.

$$Z(n+1)=Z(n)\times a\times bs^{s}\times bm^{m}\times bl^{l}$$

Here, in the Z (n+1), n is a natural number including 0, Z (0) is a constant, a is a constant which is determined based on ink characteristics (such as the thickening or ink composition) (a constant indicating the degree of progress of the thickening per time t0), and bs, bm, and bl are constants illustrating the change of the degree of thickening when respectively forming the small dot, the middle dot, and the large dot, s, m, and l are numbers of discharged ink droplets (in other words, numbers of formed dots) of the respective small dot, the middle dot, and the large dot during the n-th unit period (a discharge period). In the embodiment, for example, Z (0)=1, a=1.05, bs=0.9, bm=0.8, and bl=0.7.

In addition, the n-th unit period of time t0 is represented by the following Expression.

$$t0=N\times T$$

Here, N is a natural number, and N is 1 in the embodiment. Further, in the embodiment T=0.1 (s).

In addition, the printer driver 9 can determine whether dots having any size is formed in each unit period T, or the non-recorded area is formed based on the dot pattern data, and in accordance with this, the thickening value Z is updated. For example, in a predetermined nozzle 37, in a case of the non-recorded area during a first period T (1), the non-recorded area during the next period T (2), and discharge (forming the small dots) during the next period T (3), the thickening value Z (n+1) relating to the nozzle 37 is transitioned as follows; "1"→"1×1.05=1.05"→"1×1.05×1.05=1.1025"→"1×1.05×1.05×1.05×0.9≈1.0419". That is, the thickening value Z (n+1) is increased in a case of the non-recorded area, whereas the thickening value Z (n+1) is decreased in a case of the discharge (that is, forming dots).

In addition, in the thickening value Z (n+1), a threshold is set in advance, and is set to, for example, 50 in the embodiment. In a case where the thickening value Z (n+1) is equal to or greater than the threshold, when forming the small dots, there is a concern in that the image quality is deteriorated due to flight bending of the dots or the like as described above. The thickened state when the thickening value Z (n+1) is equal to the threshold corresponds to a predetermined state in the invention. For this reason, the printer driver 9 monitors the thickening value Z (n+1) for each nozzle 37, and determines whether or not the thickening value Z (n+1) is equal to or greater than the threshold (step S5). When it is determined that the thickening value Z (n+1) is equal to or greater than the threshold (Yes in step S5), with respect to the dot pattern data of the nozzle 37, the correcting process of replacing information indicating that the small dots are formed during the period in which the thickening value Z (n+1) is equal to or greater than the threshold with information indicating that the larger dots are formed is executed (step S6). Specifically, with respect to the dot pattern data of the nozzle 37, the printer driver 9 executes the correcting process of replacing information indicating that the small dots are formed during the period in which the thickening value is equal to or greater than the threshold with, for example, information indicating that the middle dots are formed (step S6).

Meanwhile, even during the period in which the thickening value is equal to or greater than the threshold, if there is information indicating that dots other than the small dots are formed, the information is maintained as it is. If the data is corrected in step S6, the process proceeds to step S7 (described below). On the other hand, when it is determined that the thickening value Z (n+1) is smaller than the threshold (No in step S5), it is determined whether or not there is unprocessed image data or the like (step S7). When it is determined that there is unprocessed data (Yes in step S7), the process returns to step S1, and the following process is executed. Here, as described above, even after the thickening value Z (n+1) of a predetermined nozzle 37 becomes equal to or greater than the threshold, the thickening value Z (n+1) is decreased as the ink droplets are discharged from the nozzle 37. For this reason, in step S5, when it is determined that the thickening value Z (n+1) is smaller than the threshold (that is, returned to the thickening value (a second state) before the thickening value is equal to or greater than the threshold) (No in step S5), the printer driver 9 maintains the original information indicating that the small dots are formed without replacing the information of the dot pattern data, which indicates that the small dots are formed with the alternative driving waveform (that is, the correction is not executed in step S6). Here, it is considered that the thickening of ink is progressed not only in the nozzle 37 but also in the pressure chamber 38 which is disposed upper stream of the nozzle 37. In consideration of such a case, it is preferable that when a threshold at the time of determining that it has become the predetermined state is set to be a first threshold value, a second threshold at the time of determining that it has returned to the second state after temporarily becoming the predetermined state is set to be a different value from that of the first threshold. Specifically, for example, it is possible to set the first threshold to be greater than the second threshold. The second threshold can be determined by reflecting information such as printing density in the periphery (that is, proportion of dots formed in the periphery of the small dots (for example, pixels in eight directions centering the small dots) formed by the nozzle 37), or color (types of ink).

In addition, even after the thickening value Z (n+1) is returned to be smaller than the threshold, it can also be considered that the thickening value Z (n+1) is immediately equal to or greater than the threshold if the non-recorded area is subsequently formed. In such a case, if the size of dot, that is, the driving waveform is frequently changed, the vibration generated in the ink in the pressure chamber 38 and the nozzle 37 is complicated, and thus there is a concern that an adverse effect on discharge characteristics may occur. For this reason, even when the thickening value Z (n+1) is less than the threshold, the data correction is executed on the small dots until a predetermined period (a period of a predetermined number) has elapsed, and thus if the period has elapsed and the thickening value Z (n+1) is less than the threshold, it is possible to control the original information indicating that the small dots are formed to be maintained without executing the correcting process.

In addition, in step S7, when it is determined that the unprocessed data does not exist, that is, the process such as data conversion for all items of image data is completed (No in step S7), the spooled dot pattern data is sequentially transmitted to the printer 3 (step S8).

In this way, in the printer 3, the recording process is executed based on the dot pattern data received from the host computer 1, for the nozzle 37 having the thickening value Z (n+1) which is equal to or greater than the threshold, when the small dots are formed during the period in which the thickening value is equal to or greater than the threshold, normally the first discharge driving pulse DP1 is selected so as to be applied to the piezoelectric element 20, but the second discharge driving pulse DP2 having the higher discharge capability (that is, the force used to discharge the ink (pressure) is stronger) is selected as the alternative driving waveform so as to be applied to the piezoelectric element 20. In a state where the thickening value is equal to or greater than the threshold, since the amount of the ink or the flying speed thereof discharged from the nozzle 37 is smaller than the original target value, when the ink is discharged from the nozzle 37 by the second discharge driving pulse DP2, it is possible to obtain discharge characteristics which is close to a case of discharging the ink droplets corresponding to the small dots (the amount of the ink droplets or the flying speed of the ink droplets). For this reason, it is possible to suppress the impact position deviation when the small dots are formed in a state where the ink is thickened. In addition, after the thickened state becomes equal to or greater than the threshold, when the thickening value Z (n+1) is smaller than the threshold (that is, returned to the state before being equal to or greater than the threshold), in the dot pattern data of the subsequent period, since the original first discharge driving pulse DP1 is maintained as it is without executing replacing with the alternative driving waveform, it is possible to maintain the constant discharge characteristics at all time regardless of the thickening of ink in the nozzle 37.

Meanwhile, as the device driver of the invention, the printer driver 9 is exemplified, but the device driver may be any one as long as it is possible to execute the above-described process (particularly, processes from step S4 to step S6) on the job data causing the line type liquid discharge apparatus to execute the liquid discharging operation.

As described above, in the printing system and the printer driver 9 according to the invention, in a case where the degree of thickening becomes the predetermined state (the thickening value Z (n+1) is equal to or greater than the threshold), when the small dots are formed, the alternative driving waveform (the second discharge driving pulse DP2 in the embodiment) having the higher discharge capability of ink is selected instead of the first discharge driving pulse DP1 so as to be applied to the piezoelectric element 20 corresponding to the nozzle 37. In addition, first, in a case where the degree of thickening which becomes the predetermined state is, thereafter, returned to the second state before becoming the predetermined state, when the small dots are formed, the first discharge driving pulse DP1 is selected so as to be applied to the piezoelectric element 20, and thus even with a so-called line type printer 3 having a difficulty in executing the flushing operation during the recording process (that is, during the liquid discharge operation of forming dots on the impacted object by injecting liquids with respect to the impacted object), it is possible to maintain the amount of the ink droplets or the flying speed thereof when forming, particularly, the small dots to be in the state of being close to the target value regardless of the thickened state of each nozzle 37. In this way, the small dot size is set to a target for switching over the large dot size (in other words, a target for switching the first discharge driving pulse DP1 over to the alternative driving waveform), and thus it is possible to efficiently prevent the image quality of the image or the like which is recorded by, for example, the arrangement of dots from being deteriorated (deviation of the target image quality). In addition, since it is necessary to correct the dot pattern data based on the thickening value Z (n+1) corresponding to all the nozzles 37 in the recording head 18, the estimation of the degree of thickening and the correcting process of the dot pattern data based on the thickening value Z (n+1) are executed by the printer driver 9 of the host apparatus (in the embodiment the host computer 1) having a high-performance computing capability compared with that of the typical the printer 3, and then the dot pattern data is corrected when the degree of thickening becomes a predetermined state, that is, a thickening value which is an estimated value of the degree of thickening is equal to or greater than the threshold, and therefore, since there is no additional process for the printer 3, there is no concern in that the liquid discharging operation is deteriorated. In addition, based on the dot pattern data and the thickening value Z (n+1), it is possible to recognize the degree of the thickening of ink for each of the nozzles 37 in advance. With this, it is possible to reliably prevent the processing speed of the recording process in the printer 3 from being reduced. In addition, in a configuration of employing various actuators such as the heating element or the electrostatic actuator without limiting to the piezoelectric element 20, it is possible to more accurately recognize the degree of the thickening of ink.

Moreover, in the embodiment, it is possible to prevent defects such as the impact position deviation of the ink droplets with simple control of selecting the second discharge driving pulse DP2 as the alternative driving waveform of the first discharge driving pulse DP1.

In addition, it is also possible to execute the flushing operation in the above-described configuration. That is, for example, the flushing operation can be performed only at the time when the recording of at least one sheet of paper is completed in the recording process with respect to the sheet-like recording paper 30, or after a series of recording processes with respect to the roll recording paper is competed in the recording process with respect to the roll recording paper 30. Even in this case, it is possible to reduce the frequency of the flushing operation, and thus it is possible to improve the processing speed and reduce the amount of ink and reduce the amount of ink consumed in the flushing operation.

Meanwhile, in the embodiment, the process such as a correction of the dot pattern data when the degree of the thickening of ink for each of the nozzles 37 becomes the predetermined state (that is, Z the threshold) is executed by the printer driver 9 of the host computer 1 which is the host apparatus; however, these processes (processes of the step S1 to step S7) may be executed by the printer 3 without limiting the printer driver 9. That is, in a second embodiment, the printer driver 9 transmits the printing job data to the printer 3 without executing a process of converting the printing job data into the dot pattern data. The CPU 11 of the printer 3 converts the received printing job data into the dot pattern data in the above-described procedure, and executes the correcting process of estimating the degree of thickening and the dot pattern data based on the thickening value Z (n+1) for each of the nozzles. In addition, the head control unit 19 of the recording head 18 controls to select the driving pulse and apply with respect to the piezoelectric element 20 based on the dot pattern data on which the above processes have executed. That is, for the nozzle 37, in a case where the thickening value Z (n+1) is equal to or greater than the threshold, when the small dots are formed during the period, the alternative driving waveform having the higher discharge capability of ink is selected instead of the first discharge driving pulse DP1 so as to be applied to the piezoelectric element 20. On the other hand, for the nozzle 37, in a case where the thickening value Z (n+1) is smaller than the threshold, when the small dots are formed during the period, the first discharge driving pulse DP1 is selected so as to be applied to the piezoelectric element 20 without the replacing of the waveform. In this configuration, the CPU 11 and the head control unit 19 function as a control circuit in the invention. In this configuration, similar to the first embodiment, even with a so-called line type printer 3 having a difficult in executing the flushing operation during the recording process (that is, during the liquid discharge operation of forming dots on the impacted object by injecting liquids with respect to the impacted object), it is possible to maintain the amount of the ink droplets or the flying speed when forming, particularly, the small dots to be in the state of being close to the target value regardless of the thickened state of each nozzle 37. As a result, it is possible to prevent the image quality of a recorded image or the like from being deteriorated by suppressing defects such as the impact position deviation of the ink droplets with respect to the printing paper 30.

Figure 8:
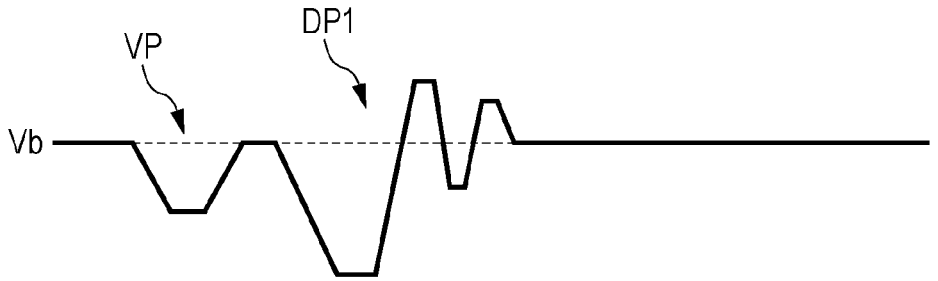
FIG. 8 is a waveform chart illustrating another example of an alternative driving waveform.

In addition, the alternative driving waveform is not limited to the second discharge driving pulse DP2 for forming the middle dots, and as illustrated in FIG. 8, it is possible to employ a configuration such that the micro vibration driving pulse VP and the first discharge driving pulse DP1 are combined together and then applied to the piezoelectric element 20 so as to form the alternative driving waveform. That is, for the nozzle 37, in a case where the thickening value Z (n+1) is equal to or greater than the threshold, when the small dots are formed during a period in which the thickening value is equal to or greater than the threshold, the micro vibration driving pulse VP during the period T1 and the first discharge driving pulse DP1 during the period T2 are sequentially selected instead of the first discharge driving pulse DP1 and then applied to the piezoelectric element 20. In this configuration, the micro vibration driving pulse VP and the first discharge driving pulse DP1 are combined together, and thus the discharge capability (pressure change is generated in the ink in the pressure chamber 38) is improved as compared with the first discharge driving pulse DP1, whereas the discharge capability can be set to be low compared with the second discharge driving pulse DP2. Therefore, even in a state where discharge characteristics such as the amount of the ink droplets or the flying speed thereof are increased compared with the target value when the second discharge driving pulse DP2 is set to be the alternative driving waveform, it is possible to obtain the discharge characteristics which are close to the target value.

Specifically, it is possible to adjust the amount the ink droplets and the flying speed thereof which are discharged from the nozzle 37 by adjusting the height of waveform of the micro vibration driving pulse VP. That is, it is possible to improve the discharge capability by enhancing the height of waveform of the micro vibration driving pulse VP (the potential difference from the lowest potential to the highest potential), or reversely, it is possible to adjust the discharge capability by lowering the height of waveform (a peak value). In addition, it is possible to adjust the amount of the ink droplets and the flying speed thereof discharged from the nozzle 37 by adjusting a gap between the micro vibration driving pulse VP and the first discharge driving pulse DP1. For example, the time Δt from a start end of the waveform element p2 of the micro vibration during pulse VP to the waveform element p3 of the first discharge driving pulse DP1 is set to a half of the period Tc of the pressure vibration which is generated in the ink in the pressure chamber 38, and thus the pressure vibration which is generated by the waveform element p2 of the micro vibration during pulse VP and the pressure vibration which is generated by the waveform element p3 of the first discharge driving pulse DP1 are resonated. Therefore, the amount of the ink droplets and the flying speed thereof discharged from the nozzle 37 are increased. Note that, it is possible to suppress the discharge capability by shifting the aforementioned time Δt with respect to the half of the period Tc to weaken the resonance.

Further, an example of the alternative driving waveform is not limited to a driving waveform which is different from the first discharge driving pulse DP1, or the combination of the micro vibration driving pulse VP and the first discharge driving pulse DP1. For example, the height of waveform of the first discharge driving pulse DP1 which is corrected to be enhanced can be used as the alternative driving waveform.

Meanwhile, as described above, defects such as the impact position deviation due to the thickening of ink mainly occur when forming the small dots, but the invention is also applicable to a case where defects due to the thickening of ink occur when forming the middle dots. Specifically, for example, in a case where a very small amount (a few droplets) of the middle dots are intermittently formed, it is likely that defects such as the impact position deviation occur due to the thickening of ink. The invention is applicable to the middle dots in this case as a type of the small dots of the invention. In this case, for example, the height of waveform of the second discharge driving pulse DP2 is corrected to be high can be used as the alternative waveform.

In addition, in the above-described embodiment, as the actuator, a so-called flexure-vibration type piezoelectric element 20 is exemplified, but the example of the actuator is not limited thereto, for example, the invention is applicable to a case of using a variety of actuator such as an electrostatic actuator changing the capacity of the pressure chamber by using a so-called longitudinal-vibration type piezoelectric element, a heating element, and an electrostatic force.

Further, in the above-described embodiment, the degree of the thickening is estimated based on the thickening value Z (n+1), but is not limited thereto. For example, the degree of the thickening of ink may be detected based on a reverse electromotive force signal which is generated in the piezoelectric element 20 due to the residual vibration after discharging the ink droplets. That is, after the piezoelectric element 20 is driven, an elastic membrane 40 which is an operating unit of the pressure chamber 38 is vibrated in accordance with the pressure vibration generated in the ink in the pressure chamber 38. With this, a reverse electromotive force is generated in the piezoelectric element 20 based on this vibration. In addition, for example, the amount of ink or the flying speed thereof discharged from the nozzle 37 is remarkably decreased with respect to the target value in a state where the thickening of ink progresses, and in this case, a period component, an amplitude component, and a phase component of the above-described reverse electromotive force signal is different from that in a normal state. For this reason, for example, a normal range is previously defined for each component described above, and a state in which each component of the detection signal is out of the specified range is assumed to be a predetermined state of the invention. Based on this, it is possible to anticipate the same operation and effect as in the first embodiment by adopting a configuration of correcting the dot pattern data as described above. Note that, since the method of determining the state of the ink based on the residual vibration after discharging the ink droplets is well-known, the detailed description will be omitted.

Next, a second embodiment of the invention will be described. In the first embodiment, the line type printer 3 is exemplified as an example of the liquid discharge apparatus of the invention, but it is possible to apply the invention to the so-called serial type printer 3' as illustrated in FIG. 1. A recording head 45 which is a type of the liquid discharge head in the embodiment is attached to the bottom surface of a carriage 46 on which an ink cartridge (not shown) is storing the ink. In addition, the carriage 46 is configured so as to reciprocally move along a guide rod 47. That is, the printer 3' sequentially transports the recording paper on the platen 48, injects the ink from the nozzle of the recording head 45 while relatively moving the recording head 45 in the width direction (that is, in the main scanning direction) of the recording paper, and then impacts the ink on the recording paper so as to record an image or the like.

Figure 9:
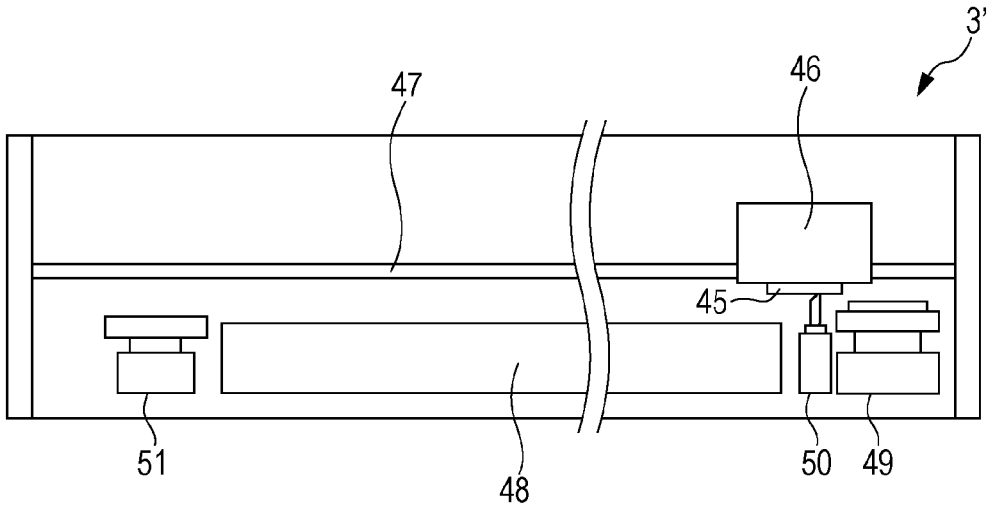
FIG. 9 is a perspective view illustrating an internal configuration of a printer in a second embodiment.

A home position which is a stand-by position of the recording head 45 is set as a position deviated to one end side (the right side in FIG. 9) in the main scanning direction with respect to the platen 48. In this home position, a capping mechanism 49 and a wiping mechanism 50 are provided in order from the one end side. In addition, as a flushing area, a flushing box 51 is provided at the other end portion (the left side in FIG. 9) in the main scanning direction by interposing the platen 48 between the home position and the flushing box. The capping mechanism 49 can execute a cleaning process of discharging the ink from the nozzle into a cap by bringing a space in the cap to a negative pressure in a state of executing the capping with respect to the nozzle surface of the recording head 3'. In addition, the cap also functions as an ink receiving portion which receives the ink ejected at the time of the flushing operation. The above-described flushing box 51 receives the ink ejected at the time of the flushing operation of forcedly ejecting the ink from the nozzle of the recording head 45 regardless of the recording process.

The printer 3' in the embodiment is configured so as to select any one of a first mode which in the control of replacing the small dots in accordance with the degree of the thickening (the thickening value Z) similar to the first embodiment is executed, the flushing operation is not executed at least until the recording process for each recording paper is completed, or the flushing operation is not executed at all during the recording process, and a second mode in which the flushing operation is executed at a predetermined interval during the recording process without controlling the replacement of the small dots. In short, in the first mode, the flushing operation cannot not be executed at all during the printing process, or the execution frequency of the flushing operation is relatively low, in contrast, in the second mode, the flushing operation can be executed during the printing process (in a case where the flushing operation is not executed in the first mode), or the execution frequency of the flushing operation is relatively high (in a case where the flushing operation is executed in the first mode).

In addition, in the printer 3' in the embodiment, the first mode or the second mode is selected in accordance with contents to be recorded on the recording paper. For example, when priority is given to the processing speed as the text printing, the first mode is selected. With this, the execution frequency of the flushing operation in the printing process is lowered, or since it is possible not to execute the flushing operation, the speed of printing process can be improved, and it is possible to reduce the amount of ink consumed in the flushing operation. In addition, for example, when priority is given to the image quality of the image or the like which is recorded on the recording paper, the second mode is selected. With this, since the flushing operation is executed during the printing process, it is possible to more reliably suppress the deterioration of the image quality due to the thickening of the ink.

In addition, in the configuration of executing the flushing operation at a predetermined interval in the printing process, or the configuration of executing the flushing operation during the printing processes of each piece of recording paper (that is, during paper feed), whenever it is the timing which is set for the execution of flushing operation, or the timing which is capable of executing the flushing operation (hereinafter, simply refer to the timing of the flushing operation), it is possible to determine whether to execute the flushing operation based on the thickening value Z. Specifically, it is assumed that the flushing operation is not executed in a case where the thickening value Z is estimated not to be greater than the threshold until the next timing of the flushing operation, but in a case where the thickening value Z is estimated to be greater than the threshold until the next timing of the flushing operation, it is assumed that the flushing operation can be not executed. Accordingly, since it is possible to optimize the execution frequency of the flushing operation, it is possible to realize a further high-speed of the printing process becoming possible.

Typically, the second mode is set as another Modification example, but it may be switched to the first mode when the remaining amount of the ink in the ink cartridge becomes small. According to this configuration, since it is possible to suppress the ink consumption due to the flushing operation, it is possible to reduce the frequency of replacement of the ink cartridge. Meanwhile, the description of the control of replacing the small dots in accordance with the degree of the thickening is the same as the first embodiment, and therefore, the description thereof will be omitted.

The invention is not limited to the above-described printer 3, but is applicable to a variety of ink jet type recording apparatuses such as a plotter, a facsimile machine, and a copier, or a liquid droplet discharge apparatus such as a printing apparatus which executes printing on fabric (a material to be printed) which is a type of an impacted object by impacting the ink from the line type liquid discharge head. In addition, the invention is applicable to a device driver relating to the above-described apparatuses.

What is claimed is:

1. A liquid discharge apparatus comprising:

a liquid discharge head that includes a plurality of nozzles, discharges a liquid from the nozzles by driving of an actuator, and then forms dots with impacted liquids on an impacted object;

a driving waveform generation circuit that generates a driving waveform for driving the actuator; and a control circuit that controls discharging of the liquid by the liquid discharge head based on discharge data including information indicating a size of a dot formed on the impacted object, wherein the control circuit calculates a degree of thickening of the liquid for each of the nozzles, and discharges relatively large dots compared to small dots to an area on which relatively the smallest dots are supposed to be formed from the nozzles based on the discharge data when the degree of thickening of the liquid in the nozzle becomes a predetermined state which is determined in advance.

2. The liquid discharge apparatus according to claim 1, wherein when n is set to a natural number including 0, Z (0) is set to a constant indicating an initial value of the degree of thickening, a is set to a constant which is determined based on liquid characteristics, bs, bm, and bl are set to constants respectively relating to the small dot, a middle dot which is larger than the small dot, and a large dot which is larger than the middle dot, and s, m, and l are set to numbers of discharged ink droplets of each of the small dot, the middle dot, and the large dot during an n-th discharge period, the degree of thickening in a predetermined discharge period is represented by the following Expression $$Z(n+1)=Z(n)\times a\times bs^{s}\times bm^{m}\times bl^{l}.$$

3. A control method of a liquid discharge apparatus which includes a liquid discharge head that includes a plurality of nozzles, discharges a liquid from the nozzles by driving of an actuator, and then forms dots with impacted liquids on an impacted object; a driving waveform generation circuit that generates a driving waveform for driving the actuator; and a control circuit that controls discharging of the liquid by the liquid discharge head based on discharge data including information indicating a size of a dot formed on the impacted object, the method comprising:

calculating degree of thickening of a liquid for each of the nozzles; and discharging relatively large dots compared to small dots to an area on which relatively the smallest dots are supposed to be formed based on the discharge data from the nozzles when the degree of thickening of the liquid in the nozzle becomes a predetermined state which is determined in advance.

4. A device driver that is executable in a host apparatus which is communicably connected to a liquid discharge apparatus that includes a plurality of nozzles, discharges a liquid from the nozzles by driving of an actuator, and then forms dots with impacted liquids on an impacted object, the device driver causing the host apparatus to execute:

generating discharge data which includes information indicating a size of dots formed on an impacted object from job data for causing the liquid discharge apparatus to execute a liquid discharge operation;

calculating degree of thickening of a liquid based on the discharge data for each of the nozzles; and replacing information of the discharge data corresponding to the nozzles, which indicates that relatively smallest dots are formed with information indicating that dots which are larger than small dots are formed when the degree of thickening of the liquid in the nozzle becomes a predetermined state which is determined in advance.

5. A printing system that is formed of a host apparatus and a liquid discharge apparatus which is communicably connected to the host apparatus, wherein the liquid discharge apparatus includes a liquid discharge head that includes a plurality of nozzles, discharges a liquid from the nozzles by driving of an actuator, and then forms dots with impacted liquids on an impacted object; and a driving waveform generation circuit that generates a driving waveform for driving the actuator, wherein the driving waveform generation circuit generates a driving waveform in accordance with a size of a dot which is formed on the impacted object, and the host apparatus executes a device driver relating to a liquid discharging operation in the liquid discharge apparatus, and wherein the device driver causing the host apparatus to execute:

generating discharge data including information indicating the size of the dots formed on the impacted object from job data for causing the liquid discharge apparatus to execute a liquid discharge operation;

calculating degree of thickening of a liquid based on the discharge data for each of the nozzles; and replacing information indicating that relatively smallest dots are formed in the discharge data corresponding to nozzles with information indicating that dots which are larger than small dots are formed when the degree of thickening of the liquid in the nozzle becomes a predetermined state which is determined in advance.

* * * * *